US005713149A

United States Patent [19]

Cady et al.

[11] Patent Number: 5,713,149

[45] Date of Patent: Feb. 3, 1998

[54] ELECTRONIC TRIGGER LOCK

[75] Inventors: Jefferey A. Cady, Colleyville; Gary T. Mackey, Arlington; L. Scott Hazlewood, Bonham; Robert C. Scott, Richardson, all of Tex.

[73] Assignee: Trigger Block, Inc., Dallas, Tex.

[21] Appl. No.: 585,425

[22] Filed: Jan. 11, 1996

(Under 37 CFR 1.47)

[51] Int. Cl.[6] ..... F41A 17/00

[52] U.S. Cl. ..... 42/70.06; 42/70.11

[58] Field of Search ..... 42/70.06, 70.11

[56] References Cited

U.S. PATENT DOCUMENTS

| | | | |
|---|---|---|---|
| 226,555 | 4/1880 | Schalck . | |
| 336,287 | 2/1886 | Browning . | |
| 422,327 | 2/1890 | Odkoler . | |
| 547,454 | 10/1895 | Schmeisser . | |
| 955,237 | 4/1910 | Wescott et al. . | |
| 965,386 | 7/1910 | Hansen . | |
| 1,079,855 | 11/1913 | Guarino . | |
| 1,563,250 | 6/1925 | Capon . | |
| 1,569,553 | 1/1926 | Lewis et al. . | |
| 1,686,482 | 10/1928 | Windle . | |
| 1,887,308 | 11/1932 | Jessup . | |
| 2,063,476 | 12/1936 | Wilson | 42/1 |
| 2,080,202 | 5/1937 | Drake | 42/1 |
| 2,144,755 | 1/1939 | Freedman | 24/201 |
| 2,195,693 | 4/1940 | Clifton | 42/70 |
| 2,401,482 | 6/1946 | Hendey | 42/70 |
| 2,444,649 | 7/1948 | Jacobs | 42/70 |
| 2,447,755 | 8/1948 | Kirkland et al. | 68/92 |
| 2,503,953 | 4/1950 | Lind | 42/70 |
| 2,505,227 | 4/1950 | Charters | 42/70 |
| 2,512,140 | 6/1950 | Childs et al. | 42/70 |
| 2,525,886 | 10/1950 | Fraser | 42/70 |
| 2,555,316 | 6/1951 | Cerf, Jr. | 70/364 |
| 2,590,516 | 3/1952 | De Von Breymann | 42/70 |
| 2,598,924 | 6/1952 | Lind | 42/70 |
| 2,599,132 | 6/1952 | Sass | 42/70 |
| 2,657,490 | 11/1953 | Browning | 42/70 |
| 2,664,658 | 1/1954 | Bjorklund | 42/70 |
| 2,709,865 | 6/1955 | Bohenek | 42/70 |
| 2,742,726 | 4/1956 | Feller | 42/70 |
| 2,780,261 | 2/1957 | Svec et al. | 150/3 |
| 2,859,551 | 11/1958 | Buchanan | 42/1 |
| 2,882,636 | 4/1959 | Shinaver | 42/70 |
| 2,893,152 | 7/1959 | Peluso | 42/70 |
| 2,948,978 | 8/1960 | Salverda | 41/1 |
| 3,020,663 | 2/1962 | Newson | 42/70 |
| 3,022,596 | 2/1962 | Cannon | 41/1 |
| 3,031,787 | 5/1962 | Womble, Jr. | 42/70 |
| 3,064,383 | 11/1962 | Newson, Sr. | 42/70 |
| 3,066,433 | 12/1962 | Rogers et al. | 42/70 |
| 3,139,694 | 7/1964 | Schaefer | 42/70 |
| 3,164,919 | 1/1965 | Hall | 42/70 |
| 3,184,875 | 5/1965 | Klebe | 42/69 |
| 3,269,046 | 8/1966 | Schaefer | 42/70 |
| 3,352,047 | 11/1967 | McDonnell | 42/70 |

(List continued on next page.)

*Primary Examiner*—J. Woodrow Eldred
*Attorney, Agent, or Firm*—Felsman, Bradley, Gunter & Dillon, LLP

[57] ABSTRACT

An electronic trigger lock which contains a back plate which blocks access to the trigger from one side of a firearm. This back plate has a member extending from it which contains a first series of ratchet teeth. Next, an electronic portion of the electronic trigger guard is provided to block access to the other side of the trigger. This electronic portion is contained within an outer housing. A user interface is located on the exterior of the outer housing for entering information into the electronic trigger lock. This interface may be comprised of translucent colored buttons. Also, this user interface is illuminated. The outer housing has an opening for receiving the member extending from the back plate. This opening contains a second series of ratchet teeth which are adapted to engage the first series of ratchet teeth on the member. A solenoid is located inside the outer housing to enable the release of the first series of ratchet teeth from the second series of ratchet teeth. Finally, a processor, internal to the outer housing, is provided for energizing the solenoid upon receiving a predefined code from the user interface.

20 Claims, 7 Drawing Sheets

U.S. PATENT DOCUMENTS

| | | | |
|---|---|---|---|
| 3,368,297 | 2/1968 | Lentz | 42/1 |
| 3,392,471 | 7/1968 | Foote | 42/70 |
| 3,422,560 | 1/1969 | Foote et al. | 42/70 |
| 3,616,559 | 11/1971 | Sobolewski | 42/1 |
| 3,624,945 | 12/1971 | Foote | 42/1 Y |
| 3,637,180 | 1/1972 | Parry | 248/203 |
| 3,664,163 | 5/1972 | Foote | 70/58 |
| 3,711,979 | 1/1973 | Small | 42/1 Y |
| 3,713,239 | 1/1973 | Sperling | 42/1 Y |
| 3,732,641 | 5/1973 | Adajian | 42/1 Y |
| 3,861,069 | 1/1975 | Heurlén | 42/1 Y |
| 3,934,768 | 1/1976 | Jones | 224/1 R |
| 3,956,842 | 5/1976 | Ballenger | 42/1 Y |
| 3,964,200 | 6/1976 | Patterson | 42/70 E |
| 3,978,604 | 9/1976 | Smith | 42/70 E |
| 4,014,124 | 3/1977 | Oberst | 42/1 Y |
| 4,030,221 | 6/1977 | Doobenen et al. | 42/1 Y |
| 4,050,662 | 9/1977 | Pickering | 248/291 |
| 4,084,341 | 4/1978 | Cervantes | 42/1 Y |
| 4,198,026 | 4/1980 | Capolupo | 248/552 |
| 4,299,045 | 11/1981 | Cervantes | 42/1 Y |
| 4,328,687 | 5/1982 | Ritchie | 70/34 |
| 4,395,837 | 8/1983 | Durnal | 42/1 Y |
| 4,422,254 | 12/1983 | McQueen | 42/1 Y |
| 4,488,370 | 12/1984 | Lemelson | 42/70.07 |
| 4,499,681 | 2/1985 | Bako et al. | 42/70.11 |
| 4,509,281 | 4/1985 | Dreiling et al. | 42/1 Y |
| 4,644,676 | 2/1987 | Stern | 42/70.07 |
| 4,723,370 | 2/1988 | Sheehan | 42/70.07 |
| 4,825,576 | 5/1989 | Troncoso et al. | 42/70.07 |
| 4,852,286 | 8/1989 | Troncoso et al. | 42/70.07 |
| 4,916,842 | 4/1990 | Hardy | 42/70.07 |
| 4,934,083 | 6/1990 | Smith | 42/70.07 |
| 4,945,665 | 8/1990 | Nelson | 42/70.07 |
| 4,995,180 | 2/1991 | Tucker et al. | 42/70.07 |
| 5,012,605 | 5/1991 | Nichioka | 42/70.07 |
| 5,022,175 | 6/1991 | Oncke et al. | 42/70.11 |
| 5,024,017 | 6/1991 | Nishioka | 42/70.07 |
| 5,025,582 | 6/1991 | Mote, Sr. | 42/70.06 |
| 5,033,218 | 7/1991 | Nelson | 42/70.07 |
| 5,048,212 | 9/1991 | Mossberg | 42/70.11 |
| 5,050,328 | 9/1991 | Insko | 42/70 |
| 5,054,222 | 10/1991 | Hardy | 42/70.07 |
| 5,075,994 | 12/1991 | Nishioka | 42/70.07 |
| 5,153,360 | 10/1992 | Upton | 42/70.11 |
| 5,191,158 | 3/1993 | Fuller et al. | 42/70.07 |
| 5,283,971 | 2/1994 | Fuller et al. | 42/70.07 |
| 5,287,642 | 2/1994 | Scaramucci | 42/70.08 |
| 5,309,661 | 5/1994 | Fuller et al. | 42/70.07 |
| 5,361,525 | 11/1994 | Bowes | 42/70.11 |
| 5,367,811 | 11/1994 | Sansom | 42/70.07 |
| 5,371,965 | 12/1994 | Nelson | 42/70.07 |
| 5,392,551 | 2/1995 | Simpson | 42/70.07 |
| 5,392,552 | 2/1995 | McCarthy et al. | 42/70.07 |
| 5,398,438 | 3/1995 | Williams | 42/70.11 |
| 5,400,538 | 3/1995 | Shannon | 42/70.07 |
| 5,402,593 | 4/1995 | Lenkarski et al. | 42/70.06 |
| 5,417,000 | 5/1995 | Chen | 42/70.06 |
| 5,419,068 | 5/1995 | Pages et al. | 42/70.07 |
| 5,433,028 | 7/1995 | Novak et al. | 42/70.06 |
| 5,437,119 | 8/1995 | Womack | 42/70.07 |
| 5,450,684 | 9/1995 | Harris | 42/70.07 |
| 5,459,957 | 10/1995 | Winer | 42/70.11 |
| 5,487,234 | 1/1996 | Dragon | 42/70.07 |
| 5,513,460 | 5/1996 | Van Niekerk et al. | 42/70.06 |
| 5,515,633 | 5/1996 | Harris | 42/70.07 |
| 5,515,634 | 5/1996 | Kong | 42/70.11 |
| 5,535,537 | 7/1996 | Avganim | 42/70.07 |
| 5,535,605 | 7/1996 | Werner | 70/14 |
| 5,537,771 | 7/1996 | Martin | 42/70.01 |
| 5,544,440 | 8/1996 | Stockman | 42/70.07 |
| 5,551,181 | 9/1996 | Upton | 42/70.11 |

308
SERIAL EEROM
VCC
A0
A1
A2
WP
SDA
SCL
312
R
G
310
+5V
314
+9V
+9V
302
Z86E03
IOB0
IOB1
IOB2
IOB3
IOB4
IOB5
IOB6
IOB7
IOA0
IOA1
IOA2
AN1
AN2
VREF
XTAL1
XTAL2
KB3*
KB2*
KB1*
BACK LIGHT
STATUS
UNLOCK
+5V
+5V
304
S1
S2
S3
S4
S5
S6
KB1*
KB2*
KB3*
306
+9V
300
+5V

ELECTRONIC TRIGGER LOCK

BACKGROUND OF THE INVENTION

1. Field of the Invention

The present invention relates to an apparatus which prevents the accidental or unauthorized discharge of firearms. Specifically, the invention is designed to be securely positioned around the trigger guard of a firearm, thereby blocking access to the trigger of the firearm.

2. Background Information

Today, more and more people are purchasing firearms for self defense. Many of these people feel they need to have quick access to their firearm in order to protect themselves and their family. However, having a firearm within easy reach, such as under a bed or in the glove compartment of an automobile poses many potential safety problems. Perhaps the greatest of these problems is the discovery of the firearm by a small child.

To prevent a small child from accidentally discovering a loaded firearm, some people either lock their firearms away, or put them in hard to reach areas. But, such actions significantly increase the amount of time it takes one to access a firearm in an emergency situation.

Several prior art trigger locks have been developed in an effort to remedy the above situation. These prior art trigger locks are intended to allow one quick access to their firearm in the event of an emergency, while at the same time, preventing the accidental discharge of the firearm by a small child or others. However, for a variety of reasons, these prior art trigger locks do not meet the needs of firearm owners.

Some prior art trigger locks require a key to be used to unlock them. By requiring the use of a key, these prior art trigger locks force one to go locate the key in order to remove the trigger lock from the gun. This type of operation prevents the quick and efficient removal of the trigger lock.

Other prior art trigger locks use a series of combination dials to lock the trigger lock. These prior art trigger locks overcome the deficiencies of trigger locks that require the use of keys, but they have other problems. Combination dials are deficient because they are awkward to use, as well as being difficult to see in the dark.

What is needed is a trigger lock that prevents the accidental discharge of a gun, and is quick and easy to remove. This trigger lock should also be usable in light or in darkness.

SUMMARY OF THE INVENTION

One objective of the present invention is to prevent the accidental discharge of a firearm, while allowing authorized persons to have ready access to the firearm.

It is yet another objective of the present invention to have an intuitive user interface which allows for the quick entry of a code to unlock the trigger lock.

It is yet another objective of the present invention to be operable in either light or darkness.

The above as well as additional objects, features and advantages are achieved with an electronic trigger lock which contains a back plate which blocks access to the trigger from one side of a firearm. This back plate has a member extending from it which contains a first series of ratchet teeth. Next, an electronic portion of the electronic trigger guard is provided to block access to the other side of the trigger. This electronic portion is contained within an outer housing. A user interface is located on the exterior of the outer housing for entering information into the electronic trigger lock. This interface may be comprised of translucent colored buttons. Also, this user interface is illuminated. The outer housing has an opening for receiving the member extending from the back plate. This opening contains a second series of ratchet teeth which are adapted to engage the first series of ratchet teeth on the member. A solenoid is located inside the outer housing to enable the release of the first series of ratchet teeth from the second series of ratchet teeth. Finally, a processor, internal to the outer housing, is provided for energizing the solenoid upon receiving a predefined code from the user interface.

The above as well as additional objects, features, and advantages of the invention will become apparent in the following detailed description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

Figure 1A:
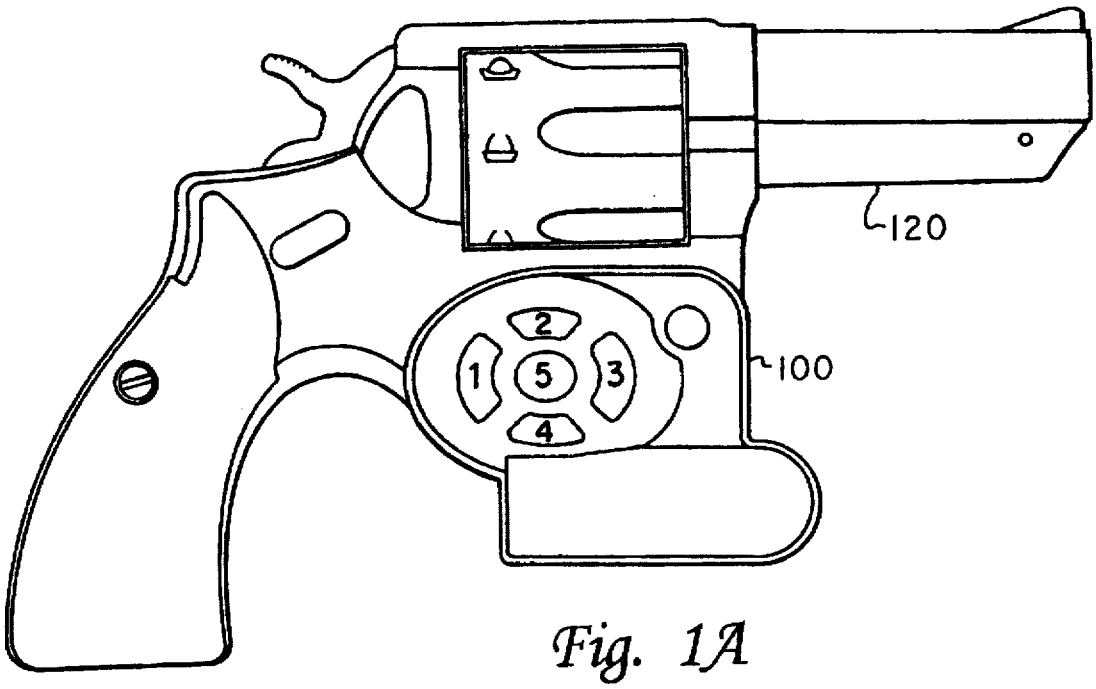
FIG. 1A illustrates an embodiment of the present invention attached to a firearm.

With respect now the drawings and in particular FIG. 1A, there is depicted an electronic trigger lock 100 attached to firearm 120. As shown in FIG. 1A, electronic trigger lock 100 is pressed tightly around the trigger guard of firearm 120. The position of electronic trigger lock 100 around the trigger guard of firearm 120 prevents persons from being able to access the trigger of firearm 120. Also shown in FIG. 1A are the buttons of electronic trigger lock 100. These buttons allow a user to enter a code to remove electronic trigger lock 100 from firearm 120.

Figure 1B:
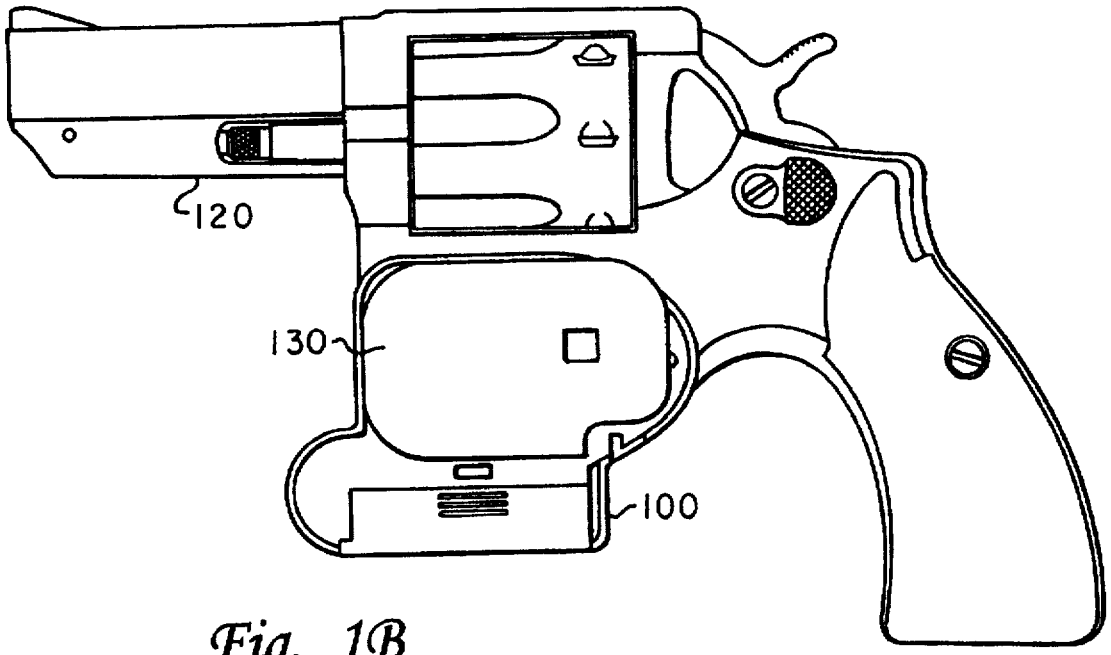
FIG. 1B presents the illustration in FIG. 1A from a different perspective.

FIG. 1B illustrates firearm 120 and electronic trigger lock 100 from a different perspective. As depicted in FIG. 1B, the back side of electronic trigger lock 100 can be seen. The rear portion of electronic trigger lock 100 is comprised of lock plate 130. Lock plate 130 can become detached from the rest of electronic trigger lock 100. Lock plate 130 is attached to electronic trigger lock 100 by a lock plate member extending from lock plate 130. This member is not shown in FIGS. 1A or 1B. The lock plate member attaches to electronic trigger lock 100 by means of a series of ratchet teeth. These ratchet teeth allow lock plate 130 to be pressed tightly together with electronic trigger lock 100 around the trigger guard of firearm 120. Thus, lock plate 130 and electronic trigger lock 100 form a barrier on either side of the trigger of firearm 120. While lock plate 130 and electric trigger block 100 may be pushed together, they cannot be pulled apart until the proper code has been entered into electronic trigger lock 100.

Figure 2A:
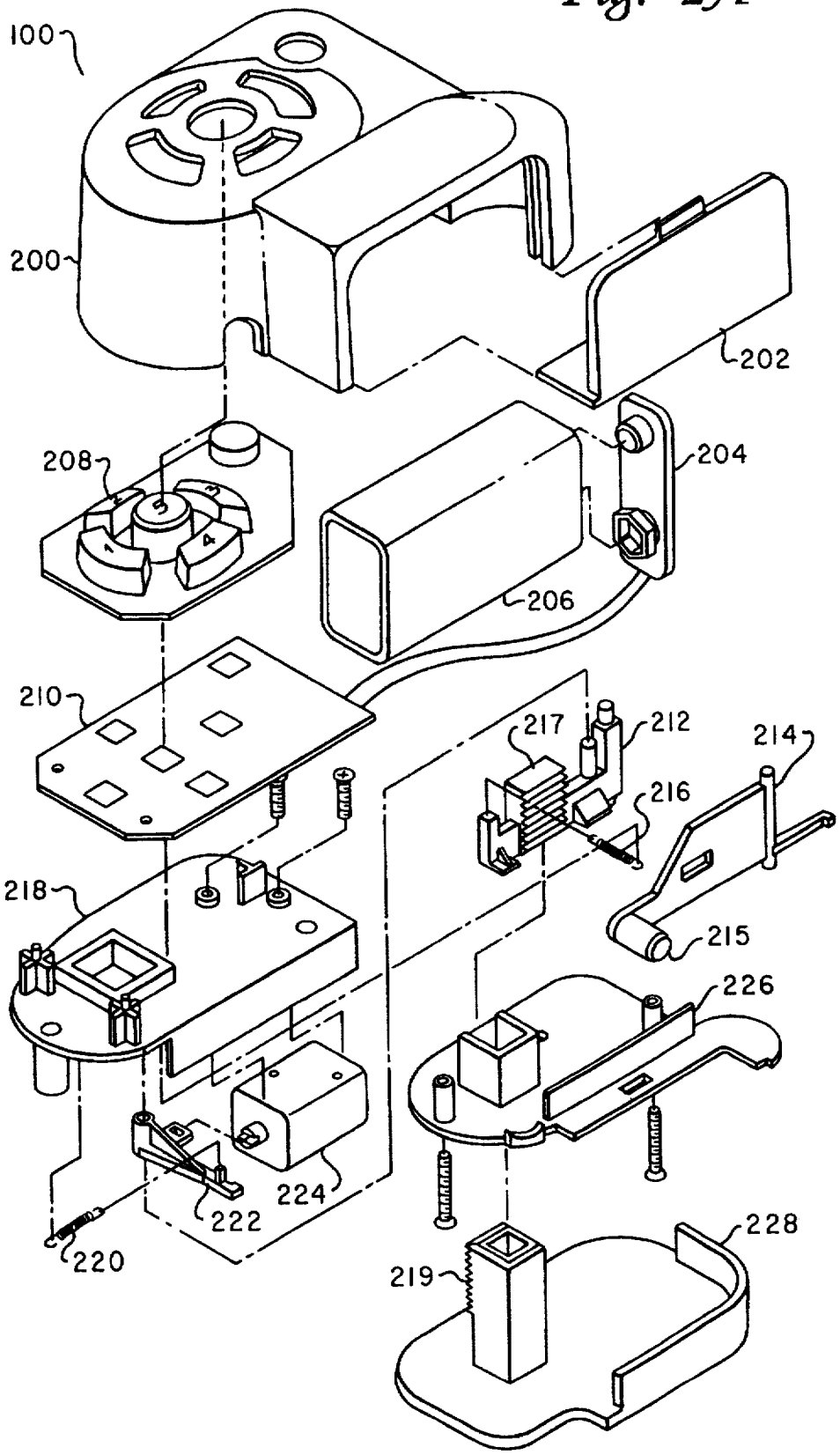
FIG. 2A depicts an exploded view of an embodiment of the present invention.

With respect now to FIG. 2, there is illustrated an exploded view of electronic trigger lock 100 as depicted in FIGS. 1A and 1B. On the outer portion of electronic trigger lock 100 is cover 200. This cover is the outer portion of electronic trigger lock 100, and may be constructed of plastic or other suitable materials. Cover 200 has an opening that is designed to receive battery door 202. In its normal position, battery door 202 is integral with cover 200. However, battery door 202 can be easily removed to allow the user to replace the 9 volt battery contained within cover 200.

Cover 200 also contains a series of openings that allow for the insertion of button pad 208. Button pad 208 contains a series of raised buttons that are designed to be inserted through cover 200. These buttons allow a user to enter a code which will allow for the removal of electronic trigger lock 100 from a firearm.

As shown in FIG. 2, the buttons on button pad 208 are marked with the numerals 1–5. A sixth, unmarked button on button pad 208 is used in entering information into electronic control block 100. The use of the sixth button as a shift button as well as a means to program electronic trigger lock 100 will be described in a following section of this specification. The buttons on button pad 208 are made of a translucent material. This translucent material allows the buttons to be back lit by a series of LEDs contained on printed circuit board 210. By being back lit in such a manner, electronic trigger lock 100 may be operated in a darken room, as the buttons on button pad 208 will be self illuminated.

While the buttons on button pad 208 are identified by the numeral 1–5, other means of identification are within the scope of this invention. For example, the buttons on button pad 208 may be constructed of colored, translucent materials. Some individuals may find it easier to remember the code needed to unlock electronic trigger lock 100 if the buttons are identified by colors instead of numbers. For example, the numeric code needed to unlock electronic trigger lock 100 may be a 4-digit number such as 1-3-5-5. If the buttons were colored instead being labeled by numerals, the code could be red-blue-green-green.

Another advantage of using colors to identify the buttons on button pad 208 is that colors may be more easily identified by those persons who are farsighted. For those individuals, the entering of the code to unlock electronic trigger lock 100 could be accomplished without the aid of glasses, thereby making the unlocking of electronic trigger lock 100 faster.

Nine volt battery 206 is provided to supply power to electronic trigger lock 100. This power is conducted from battery 206 to printed circuit board 210 by 9 volt battery clip 204.

The electrical portion of electronic trigger lock 100 is contained on printed circuit board 210. As shown in FIG. 2, printed circuit board 210 contains a series of conductive areas. These conductive areas are used to sense when a button on button pad 208 has been pressed. Also contained on printed circuit board 210 is a processor, a memory device, a series of light emitting diodes, and other circuitry. These devices and their operation will be described in a following section of this specification.

Mount plate 218 is utilized as a internal mounting device for the parts of electronic trigger lock 100 which lock and unlock the device. Pawl 212 is attached to mount plate 218 so that it may pivot. Pawl 212 contains a series of ratchet teeth 217. These ratchet teeth 217 are designed to engage the ratchet teeth 219 on lock plate 228. In its normal locked condition, pawl 212 is biased by pawl spring 216 so that its ratchet teeth 217, 219 firmly engage the corresponding ratchet teeth on lock plate 228.

To disengage the ratchet teeth on pawl 212 from the ratchet teeth on back plate 228, solenoid 224, pawl lever 222, pawl lever spring 220 and latch 214 are provided. In its normal, locked position, pawl lever spring 220 biases pawl lever 222. In this biased condition, the end of pawl lever 222 is aligned with the opening in the center of latch 214. Latch 214 is connected to mount plate 218 and back plate 226 so that when latch button 215 is depressed, latch 214 pivots around its opposite end. When pawl lever 222 is in its biased state, depressing latch button 215 causes latch 214 to move downwards. However, this downward movement of latch 214 does not put latch 214 into contact with pawl lever 222, as the end of pawl lever 222 moves through the opening in the center of latch 214.

Electronic trigger lock 100 can be removed from a firearm when printed circuit board 210 energizes solenoid 224. Solenoid 224 is connected to pawl lever 222. When solenoid 224 is energized, it pulls pawl lever 222 towards itself. The movement of pawl lever 222 is against pawl lever spring 220. In this unlocked condition, the end of pawl lever 222 is no longer aligned with the opening in the center of latch 214.

In this unlocked condition, when an operator depresses latch button 215, latch 214 contacts pawl lever 222 depressing it downward. Since pawl lever 222 is connected to pawl 212, this moves pawl 212 downward as well. This downward movement of pawl 212 disengages the ratchet teeth on pawl 212 from the ratchet teeth on lock plate member 229. This separation of ratchet teeth allows the user to pull lock plate 228 apart from the rest of electronic trigger lock 100. This separation of lock plate 228 apart from the rest of electronic trigger lock 100 reveals the trigger of the firearm. The user may then operate the firearm in a normal manner.

Back plate 226 is the exterior portion of electronic gun block 100, and helps to contain the internal parts of electronic trigger lock 100. Back plate 226 contains a rectangular opening in the center of it. This opening allows lock plate member 229 to be inserted into the internal portions of electronic trigger lock 100.

Lock plate 228 contains lock plate member 229. This rectangular member is designed to be inserted into the rectangular opening of back plate 226. Lock plate member 229 contains a series of ratchet teeth. These ratchet teeth are designed to engage the ratchet teeth of pawl 212. As was shown in FIGS. 1A and 1B, lock plate 228 prevents access to one side of the trigger of a firearm, while the rest of electronic trigger lock 100 presents access to the trigger on the opposite side.

Figure 2B:
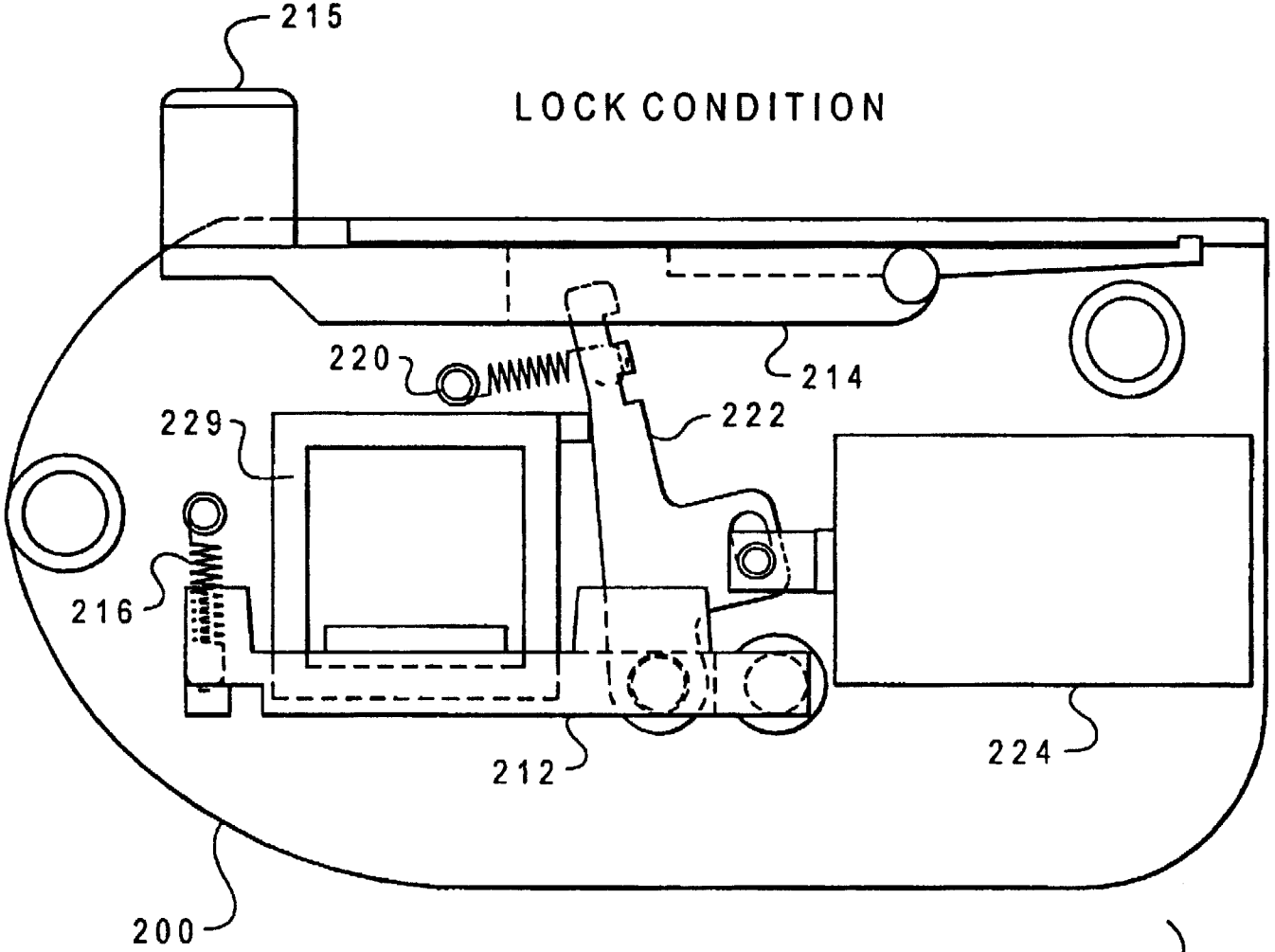
FIG. 2B illustrates a cross-sectional view of an embodiment of the present invention with the internal parts in a locked condition.

FIG. 2B illustrates a cross sectional view of an assembled electronic trigger lock 100. The positions of the internal parts of electronic trigger lock 100 in FIG. 2B are the positions of the parts in a locked state, with solenoid 224 unenergized. In this position, pawl lever 222 is biased by pawl lever spring 220. Pawl lever spring 220 holds pawl lever 222 in such a position that the end of pawl lever 222 is aligned with the opening in the center of latch 214. In this condition, if a user depresses latch button 215 thereby pushing latch 214 downward, no contact is made between latch 214 and pawl lever 222. Since pawl lever 222 cannot be pushed downward in this position, pawl 212 will not be moved by depressing latch button 215.

In this condition, pawl 212 is biased by pawl spring 216. In this biased position, the ratchet teeth of pawl 212 are firmly pressed against the corresponding teeth of lock plate member 229. This firm engagement prevents the ratchet teeth on lock plate member 229 from moving against the ratchet teeth on pawl 212. This in turn prevents someone from pulling lock plate 228 apart from the rest of electronic trigger lock 100, thereby exposing the trigger of a firearm.

Figure 2C:
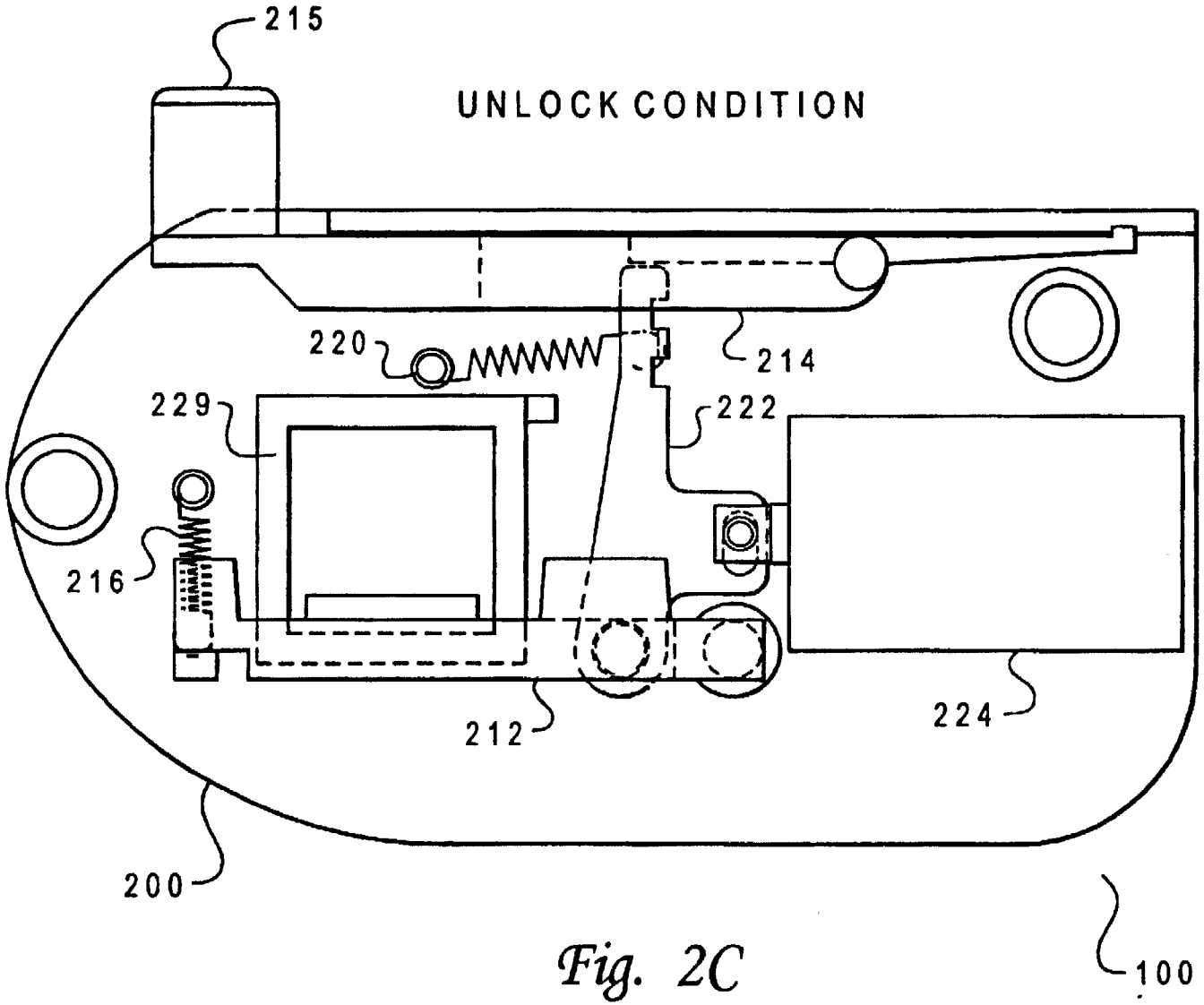
FIG. 2C illustrates a cross-sectional view of an embodiment of the present invention with the internal parts in an unlocked condition.

With respect now to FIG. 2C, a cross sectional view of electronic trigger lock 100 is shown with the internal parts in an unlocked condition. In this condition, solenoid 224 has been energized so as to pull pawl lever 224 towards its self. This movement is against pawl lever spring 220. As can be seen in FIG. 2C, the end of pawl lever 222 is no longer in alignment with the opening in the center of latch 214. In this condition, if one depresses latch button 215, thereby driving latch 214 downward, latch 214 will contact pawl lever 222. The downward movement of latch 214 will also push downward pawl lever 222. As pawl lever 222 is connected to pawl 212, this will also push pawl 212 downward against pawl spring 216. This downward movement will disengage the ratchet teeth on pawl 212 from the ratchet teeth on lock plate member 229. In this loosened condition, one can pull lock plate 228 apart from the rest of electronic trigger lock 100. By separating these two parts, a user exposes the trigger of the firearm.

Figure 3:
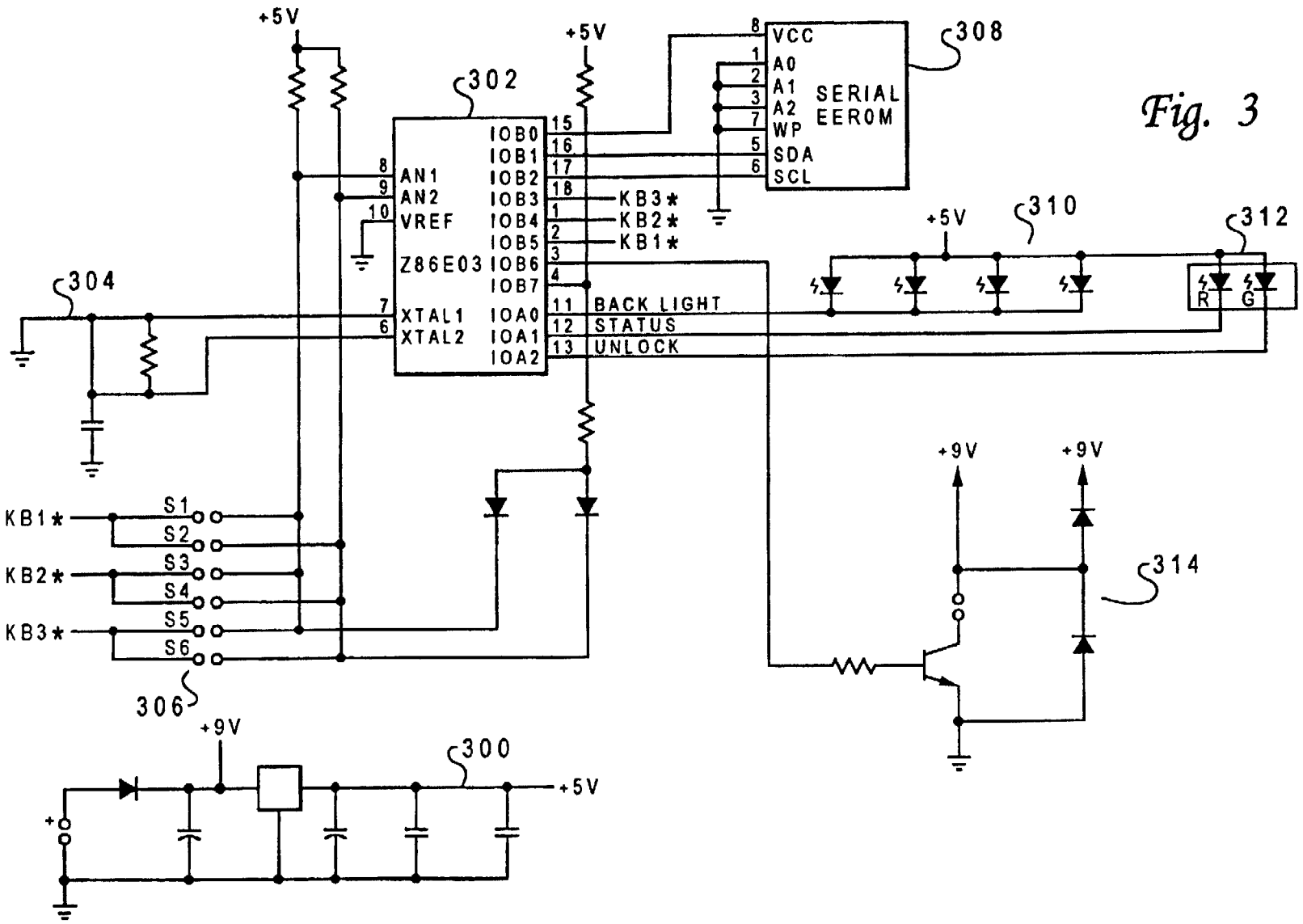
FIG. 3 depicts the circuit diagram of the electrical portion of an embodiment of the present invention.

With reference now to FIG. 3, there is depicted a circuit diagram of the electrical portion of the invention. Power circuitry 300 is provided to supply energy to the rest of the electrical system. Power circuitry 300 operates off a 9 volt battery. This circuitry reduces the 9 volts supplied by the 9 volt battery down to 5 volts in a manner well known in the art.

Button circuitry 308 allows for a user to enter a code into the electronic trigger lock to either unlock the device or to program a new electronic code into the device. Processor 302 analyzes information received from button circuitry 306. In a preferred embodiment of the present invention, processor 302 is a Z8 micro controller. Processor 302 is connected to serial EEROM 308. Serial EEROM 308 allows processor 302 to store electronic codes which, when subsequently entered, will unlock the electronic trigger lock. In a preferred embodiment of the present invention, serial EEROM 308 is a 8x128 device. An EEROM device was chosen so that electronic codes previously stored by the user can be maintained in the absence of power. Clock circuitry 304 is connected to processor 302 in order to provide a clock source.

Light emitting diodes (LEDs) 310 supply illumination to the buttons on the button pad. These LEDs make the operation of the electronic trigger lock possible in the dark. LEDs 312 are used to illuminate the shift button. LEDs 312 consist of a red LED and a green LED. If a user has entered an incorrect code, the red LED will be illuminated. This will communicate to the user that he has entered an invalid code. If the green LED is illuminated, the user knows that he entered a correct code to unlock the electronic trigger lock. The lights communicate additional information as will be described in a following section of this specification.

Solenoid circuitry 314 is also connected to processor 302. Processor 302 can send a signal to solenoid circuitry 314 that will energize the solenoid, thereby unlocking the electronic trigger lock.

Figure 4A:
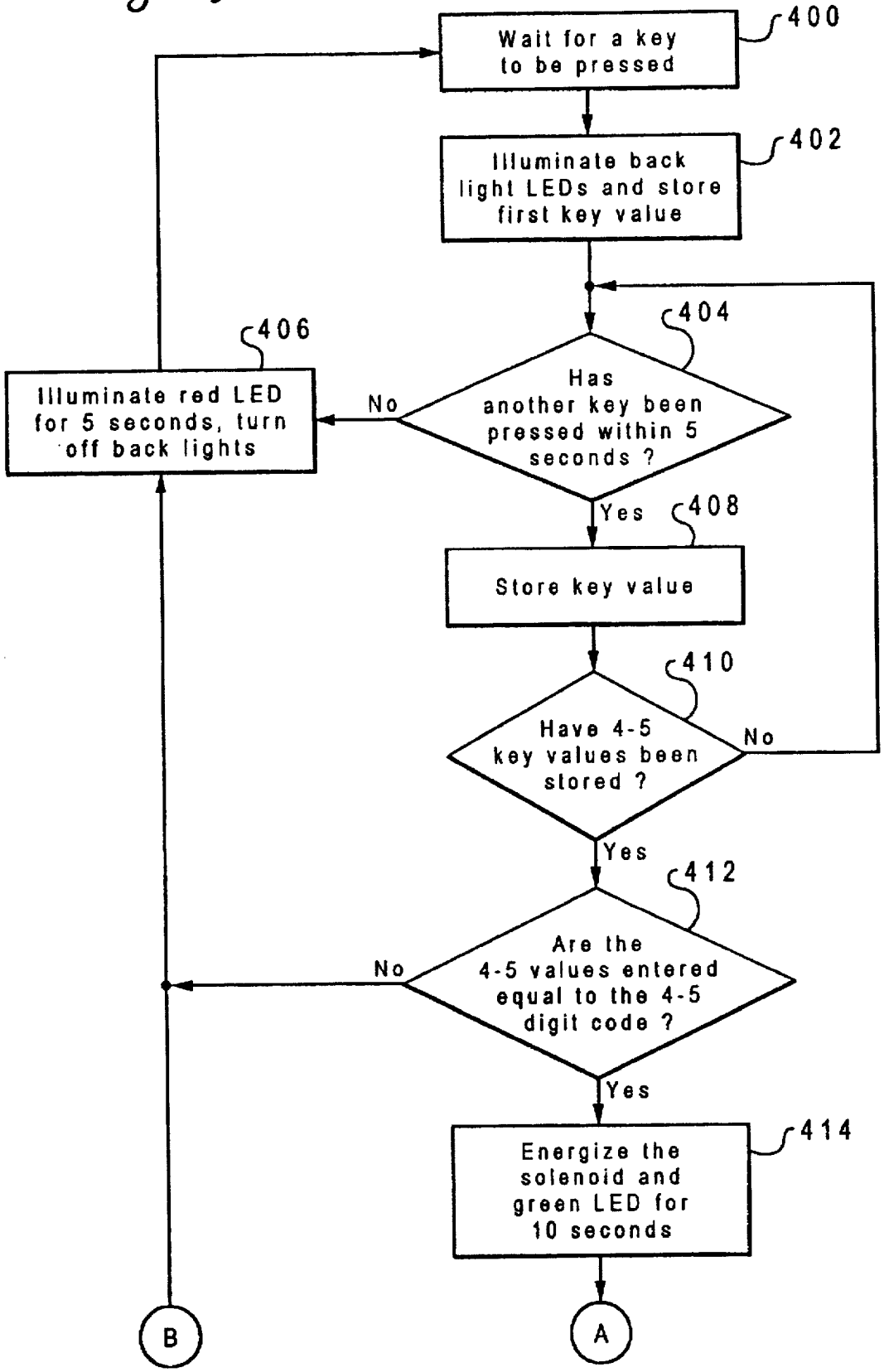
FIG. 4A illustrates a flowchart of how to operated an embodiment of the present invention.
Figure 4B:
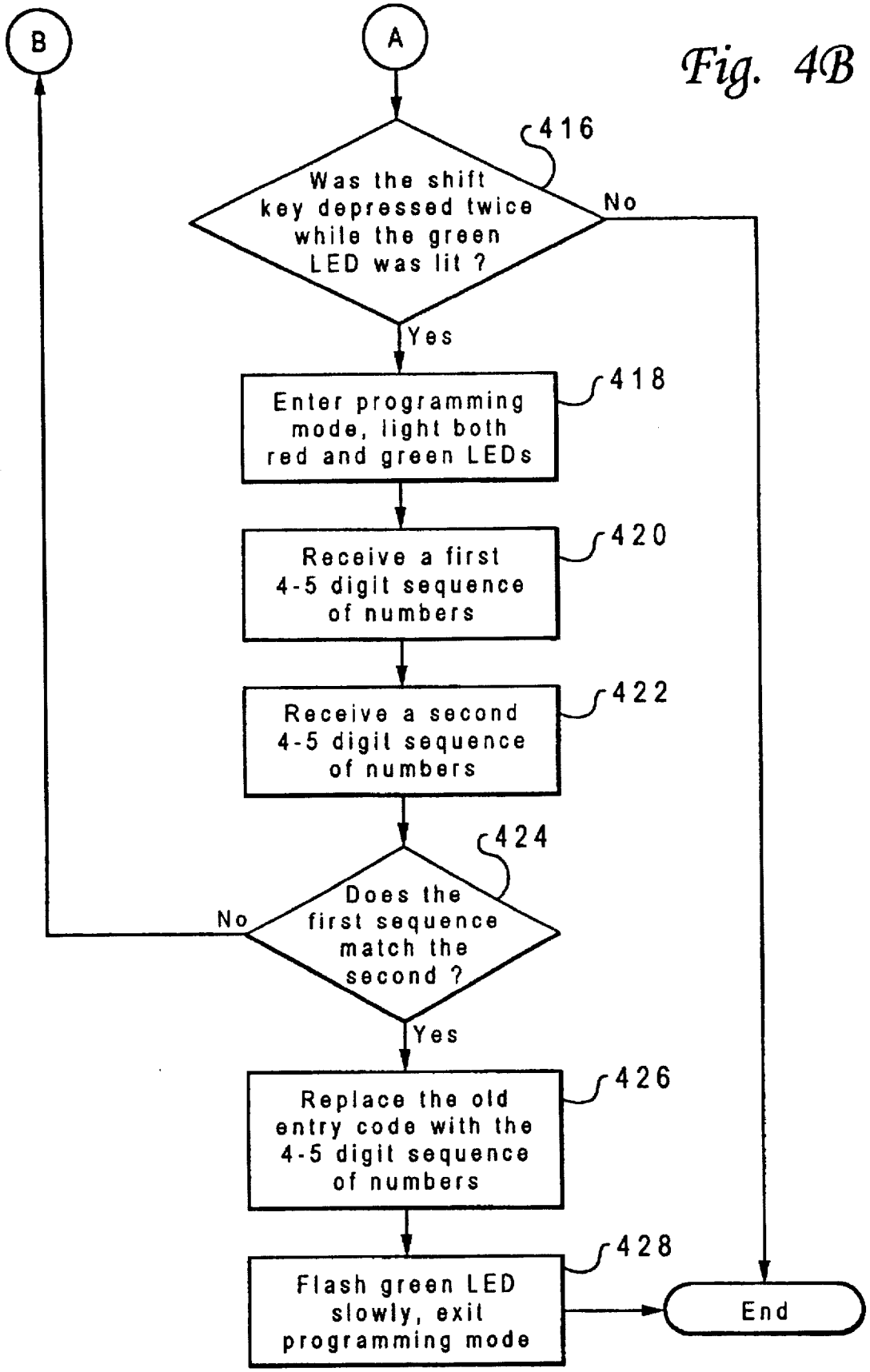
FIG. 4B is a continuation of the illustration of FIG. 4A.

With reference now to FIGS. 4A and 4B, there is depicted a flow-chart which describes the computer code which controls the processor. In its normal state, the processor is in a low-power sleep state waiting for a key to be pressed (400). Upon a key being pressed, the non-colored LEDs are activated to illuminate the key pad, and the value of the key pressed is stored (402). Numbers 1–5 may be entered directly by pressing the keys. Numbers 6–0 may be entered by first pressing the shift button, then pressing a key.

The processor then waits for another key to be pressed. If another key is not pressed after 5 seconds, the processor times-out (406). After timing out, the processor illuminates the red LED behind the shift button to signify the electronic trigger lock has not been unlocked, and turns off the non-colored LEDs (408).

If another key is pressed within 5 seconds after the first key has been pressed (404), the second key value is stored (408). This process continues until 4 or 5 key values have been stored (410).

After receiving 4 or 5 key values, the processor compares the 4–5 digit value entered with the 4–5 digit code that has been previously stored (412). If the 4–5 digit value entered matches the previously stored value, the processor energizes the solenoid for 10 seconds, and illuminates the green LED behind the shift button (414). If the 4–5 digits do not match the previously stored code, the red LED is illuminated and the non-colored LEDs are turned off.

While the device is in an unlocked condition, the user may change the 4–5 digit code required to open the electronic trigger lock. This is accomplished by pressing the shift button twice while the green LED is illuminated (416). If the shift button is pressed twice, the processor enters a programming mode. This is signified by illuminating both the red and green LEDs (418). Next, the processor receives the new 4–5 digit code (420). The processor verifies this new code by having the user re-enter the new code (422). If the two codes match each other (424), the new code is stored in place of the old code (424). This is communicated by slowly flashing the green LED (428). If the two codes do not match each other, the red LED is lit and the non-colored LEDs turned off.

While the invention has been particularly shown and described with reference to a preferred embodiment, it will be understood by those skilled in the art that various changes in form and detail may be made therein without departing from the spirit and scope of the invention.

We claim:

1. An electronic trigger lock for preventing the unauthorized access to the trigger of a firearm comprising:

a back plate which blocks access to the trigger of the firearm from a first side;

an electronic portion having an outer housing which blocks access to the trigger from a second side, the electronic portion including a locking device, the locking device including a release member;

a connecting member attached to the release member; and an actuating member adapted to engage the connecting member;

the locking device being operable in an unlock mode of operation, wherein the electronic portion positions the connecting member to be engaged by the actuating member and the connecting member acts upon the release member to unlock the electronic trigger lock.

2. The device as recited in claim 1, further comprising the locking device being operable in a lock mode of operation, wherein the actuating member does not engage the connecting member.

3. The device as recited in claim 2, wherein the electronic portion includes a positioner connected to the connecting member, wherein the positioner positions the connecting member to:

a lock position thereby putting the locking device in the lock mode of operation; and an unlock position, thereby putting the locking device in the unlock mode of operation.

4. The device as recited in claim 3 wherein the connecting member is biased to the locked position.

5. The device as recited in claim 1, wherein teeth on the release member engage corresponding teeth located on a back plate member extending from the back plate, when the locking device is operating in the lock mode of operation.

6. The device as recited in claim 5, wherein the teeth on the release member are biased to engage the teeth on the back plate member, when the locking device is operating in the lock mode of operation.

7. The device as recited in claim 3 wherein the positioner is an electric solenoid.

8. The device as recited in claim 3 further comprising a user interface, whereupon the entry of a code, the user interfaces signals the electronic portion to actuate the positioner to move the connecting member from the lock position to the unlock position.

9. An electronic trigger lock for preventing the unauthorized access to the trigger of a firearm comprising:

a back plate which blocks access to the trigger of the firearm from a first side;

an electronic portion having an outer housing which blocks access to the trigger from a second side, the electronic portion including a means for locking, the means for locking including a means for release;

a means for connecting attached to the means for release; and a means for actuating adapted to engage the means for connecting;

the means for locking being operable in an unlock mode of operation, wherein the electronic portion positions the means for connecting to be engaged by the means for actuating and the means for connecting acts upon the means for release to unlock the electronic trigger lock.

10. The device as recited in claim 9, further comprising the means for locking being operable in a lock mode of operation, wherein the means for actuating does not engage the means for connecting.

11. The device as recited in claim 10, further comprising a means for positioning connected to the means for connecting, wherein the means for positioning positions the means for connecting to:

a lock position thereby putting the means for locking in the lock mode of operation; and an unlock position, thereby putting the means for locking in the unlock mode of operation.

12. The device as recited in claim 11 wherein the means for connecting is biased to the locked position.

13. The device as recited in claim 10, wherein teeth on the means for release engage corresponding teeth located on a back plate member extending from the back plate, when the means for locking is operating in the lock mode of operation.

14. The device as recited in claim 13, wherein the teeth on the means for release are biased to engage the teeth on the back plate member, when the locking device is operating in the lock mode of operation.

15. The device as recited in claim 11 wherein the means for positioning is an electric solenoid.

16. The device as recited in claim 11 further comprising a user interface, where upon the entry of a code, the user interfaces signals the electronic portion to actuate the means for positioning to move the means for connecting from the lock position to the unlock position.

17. A method for unlocking an electronic trigger lock, comprising:

providing a back plate which blocks access to the trigger of the firearm from a first side;

providing an electronic portion having an outer housing which blocks access to the trigger from a second side, a user interface being located on the outer housing;

entering a code using the user interface;

energizing a positioner to move a connecting member into alignment with an actuating member, the connecting member being connected to a release member;

moving the actuating member to release the release member; and separating the back plate from the electronic portion to reveal the trigger of the firearm.

18. The method of claim 17, further comprising the step of moving the connecting member in response to moving the actuating member.

19. The method of claim 17, wherein the step of moving the actuating member includes manually depressing the actuating member.

20. The method of claim 17, further comprising:

analyzing the code entered using the user interface to determine if the entered code matches a predetermined access code; and if the entered code matches the predetermined access code, signaling circuitry to energize the positioner.

* * * * *